US012796729B2

(12) United States Patent
Hagen

(10) Patent No.: US 12,796,729 B2
(45) **Date of Patent: *Nov. 17, 2026**

(54) WATER PIPE

(71) Applicant: AIR IP Holdings Limited, Dubai (AE)

(72) Inventor: Klaus Hagen, Haren (DE)

(73) Assignee: AIR IP Holdings Limited, Dubai (AE)

( * ) Notice: Subject to any disclaimer, the term of this patent is extended or adjusted under 35 U.S.C. 154(b) by 0 days.

This patent is subject to a terminal disclaimer.

(21) Appl. No.: 18/319,303

(22) Filed: May 17, 2023

(65) Prior Publication Data

US 2023/0329332 A1 Oct. 19, 2023

Related U.S. Application Data

(63) Continuation of application No. 15/775,150, filed as application No. PCT/DE2016/100530 on Nov. 10, 2016, now abandoned.

(30) Foreign Application Priority Data

Nov. 10, 2015 (DE) ..... 102015119348.5
Dec. 9, 2015 (DE) ..... 102015121435.0

(51) Int. Cl.

| | |
|---|---|
| ***A24F 1/30*** | (2006.01) |
| ***A24F 40/46*** | (2020.01) |
| *A24F 40/20* | (2020.01) |
| *A24F 40/40* | (2020.01) |

(52) U.S. Cl.

CPC ..... *A24F 1/30* (2013.01); *A24F 40/20* (2020.01); *A24F 40/40* (2020.01); *A24F 40/46* (2020.01)

(58) Field of Classification Search

CPC ..... A24F 1/30

See application file for complete search history.

(56) References Cited

U.S. PATENT DOCUMENTS

| | | | | |
|---|---|---|---|---|
| 3,918,464 | A | 11/1975 | Kolodziej | |
| 4,031,906 | A | 6/1977 | Knapp | |
| 4,133,318 | A | 1/1979 | Gross | |
| 5,408,574 | A * | 4/1995 | Deevi | A24F 40/46 392/404 |
| 2006/0086364 | A1 | 4/2006 | Liu | |
| 2009/0151717 | A1 | 6/2009 | Bowen | |

(Continued)

FOREIGN PATENT DOCUMENTS

| | | |
|---|---|---|
| CN | 202276825 | 6/2012 |
| CN | 104055225 | 9/2014 |

(Continued)

OTHER PUBLICATIONS

Lotfi, Chafik, "Machine translation of FR 3019989," Translated Feb. 14, 2025, Espacenet.com. (Year: 2025).*

(Continued)

*Primary Examiner* — Philip Y Louie
*Assistant Examiner* — Sonny V Nguyen
(74) *Attorney, Agent, or Firm* — Hayes Soloway PC

(57) ABSTRACT

A water pipe has a housing into which a container to be filled with a liquid medium and having at least one suction connection and a heating chamber connected with this serving as receptacle for a smoke medium and having an air inlet are integrated. The heating chamber has a receptacle for a capsule serving for the provision of a smoke medium.

20 Claims, 6 Drawing Sheets

(56) References Cited

U.S. PATENT DOCUMENTS

| | | | | |
|---|---|---|---|---|
| 2010/0126516 | A1 | 5/2010 | Yomtov | |
| 2011/0186060 | A1 | 8/2011 | Saleh | |
| 2012/0042884 | A1 | 2/2012 | Mukaddam | |
| 2012/0067357 | A1 | 3/2012 | Boutros | |
| 2012/0199572 | A1 | 8/2012 | Shen | |
| 2014/0060554 | A1 | 3/2014 | Collett et al. | |
| 2014/0069446 | A1 | 3/2014 | Haddad | |
| 2014/0083520 | A1* | 3/2014 | Mullen | A24F 1/30 137/154 |
| 2014/0230832 | A1 | 8/2014 | Saliman | |
| 2015/0053221 | A1 | 2/2015 | Asghar-Sheikh | |
| 2016/0206001 | A1 | 7/2016 | Eng | |
| 2016/0235122 | A1 | 8/2016 | Krietzman | |
| 2016/0324215 | A1 | 11/2016 | Mironov et al. | |
| 2016/0331913 | A1 | 11/2016 | Bourque | |
| 2017/0099873 | A1 | 4/2017 | Benjamignan | |
| 2017/0251718 | A1 | 9/2017 | Amoush | |
| 2018/0271150 | A1 | 9/2018 | Sparklin | |
| 2019/0261684 | A1 | 8/2019 | Reevell | |

FOREIGN PATENT DOCUMENTS

| | | | | |
|---|---|---|---|---|
| CN | 104522890 | | 4/2015 | |
| DE | 498312 | | 5/1930 | |
| DE | 202005015795 | | 12/2005 | |
| DE | 102014005884 | A1 | 10/2015 | |
| EP | 2422633 | | 2/2012 | |
| FR | 3019989 | | 10/2015 | |
| FR | 3019989 | A1 * | 10/2015 | A24F 1/30 |
| WO | WO 2014/012216 | | 1/2014 | |

OTHER PUBLICATIONS

Liu, Pingkun, "Machine translation of CN 104522890 A", Espacenet.com, Translated Apr. 24, 2020. (Year: 2020).

Office Action issued in Corresponding Chinese Application No. 201680078450.X, dated Aug. 12, 2020 (English Translation provided).

* cited by examiner

WATER PIPE

CROSS-REFERENCE TO RELATED APPLICATIONS

This application is a continuation of U.S. application Ser. No. 15/775,150, filed May 10, 2018, which is a National Phase Entry of PCT/DE2016/100530, filed Nov. 10, 2016, which claims the benefit of priority to German Patent Application No. 10 2015 121 435.0, filed Dec. 9, 2015 and German Patent Application No. 10 2015 119 348.5, filed Nov. 10, 2015, the entire contents of each of which are hereby incorporated by reference in their entirety.

TECHNICAL FIELD

The invention concerns a water pipe with a housing into which a tank that is to be filled with a liquid medium and having at least one suction connection and a heating chamber connected with this for holding a smoke medium and fitted with an air inlet are integrated.

BACKGROUND/SUMMARY

Water pipes of this type, which originate from the Orient and are also known as shishas, have become increasingly popular in recent years as an alternative to cigarettes, in particular among young people and adolescents. A water pipe has a container that is to be filled partly with water or another liquid medium. Sucking on a mouthpiece leads to negative pressure in this container. In addition, a smoke shaft projects to an extent into the water having a head piece at the upper end to hold tobacco that is heated with coal on the upper side. The mixture of air, vapour and smoke particles that is generated through heating the tobacco is then inhaled by the smoker. It is obvious that heating with glowing coal may lead to carbon monoxide poisoning, burns injuries or in extreme cases even to fire breaking out. Because of manual filling, qualitative equipping of the shishas that is also in conformity with the law is not guaranteed. For this reason, shishas that are familiar today should only be operated in the open air or in rooms with a guaranteed supply of fresh air. In addition, shishas according to the state of the art are quite heavy and voluminous, must be put together from several parts and are inconvenient to transport in their individual parts. Their cleaning is complicated as well and frequently does not satisfy hygiene standards. Electronic shishas are familiar from U.S. Pat. No. 4,133,318 or US 2012/0199572 with which some of the above-mentioned problems could be reduced but in a not yet satisfactory manner.

For this reason, the present invention approaches the task of creating a water pipe that is characterised through particular compactness and safe use.

This task is solved in that the heating chamber has a receptacle for a capsule for holding a smoke medium.

This means that the conception for such a water pipe is completely new. It consists of a compact appliance with a tank-like container that is to be filled with water or another liquid medium and having at least one suction device through which the user draws in the mixture. There is a heating chamber for receiving a smoke medium, for example tobacco, that is located at the opposite end of the housing and has an air inlet. This principle enables a completely new, simple, direct and genuine smoking feeling thanks to compact modules and a particularly direct, effective and low loss connection between heating chamber and water tank.

In the end, the smoker draws in air at the mouthpiece, which is connected to the lid of the water tank by a tube. Ambient air flows in through the air inlet at the end of the housing opposite to the water tank. Here, the air passes through the heater-type heatable chamber and the smoke medium that is kept there and regulated to a temperature ideal for smoking. Because the heating chamber and the water tank are connected, the mixture is then drawn into the container and finally drawn in by the user through the water, the tube and the mouthpiece. It is therefore particularly expedient that the heating chamber is situated underneath the container.

One significant advantage of the shisha according to the invention is its simple, quick and also hygienically advantageous ease of use. For this purpose, the invention provides that the heating chamber has a receptacle for a capsule intended to hold a smoke medium. A capsule is thereby inserted for example from below into the oven-type heating chamber in which the smoke medium is heated up. Such capsules can contain tobacco or non-tobacco smoke media in greatly differing variants, for example as a solid, dry, fermented or moist medium with or without tar or nicotine, with differing intensity and flavours or with additives. The capsule is simply inserted into the heating chamber and after use can be just as easily removed without residue and disposed of appropriately.

The medium in the capsule is heated naturally in the heating chamber, whereby one embodiment of the invention provides that a heating element is used as the heating device in the heating chamber, preferably a heating spiral made from a flexible material, which is supplied with power by the accumulator insulated from the housing.

As an alternative it is recommended that the heating element is designed adapted to the shape of a capsule, preferably a conical shape, which in addition simplifies inserting and removing after use, in particular if the receptacle has a side wall tapering in the direction of the container and surrounding the capsule or an opening on its side towards the container. The receptacle takes over the function of a type of heating cover here. The heat input takes place advantageously in a lateral direction to the direction of the smoke.

The fact that the receptacle is designed at the same time as a heating element for the capsule proves to be an advantage in that an assembly can be saved. This receptacle forms as it were the external housing for the capsule, corresponds with the latter after insertion into the heating chamber in such a way that an unrestricted extraction effect can be achieved. Thanks to the design of the heating chamber in this section, there is no possibility that smoke medium will penetrate into the suction tube in the direction of the container.

It has already been said that the capsules are positioned in the heating chamber. With respect to this there is a suggestion according to which the heating chamber can be closed by means of a base plate, whereby the air inlet is integrated into the heating chamber, either into the base plate or the chamber wall. When the base plate, and therefore the chamber, is closed, the capsule according to the invention finds its function position itself, i.e. the end position of an inserted, latched or screwed-in base plate corresponds to the capsule in its function position, so that smoking can start.

A particularly suitable variant of the invention stipulates that, if the base plate is removed, the capsule can be inserted into the heating chamber from below. The capsule is then enclosed completely by the shisha's housing. This means that for the purpose of replacing the used cartridges with smoke medium, the base plate is detached from the heating chamber; conceivable here is a connection by means of a thread, a latch, magnet, etc. The used cartridge is then removed from the chamber and replaced by one filled with new medium and the base plate is then fixed in place again.

Put another way, the base plate is designed corresponding to a capsule for holding a smoke medium in such a way that when the base plate is fixed, inserted, screwed or latched into the housing, the capsule takes up its function position in which the smoke medium can come into contact with the drawn in air.

A particularly intensive heating effect can be achieved if an accumulator that serves to supply the heating chamber with power is integrated into the housing above the heating chamber. It is important to heat up the lower chamber, and thus the smoke medium contained there, in an effective manner with the help of the accumulator and to maintain the optimum smoke temperature.

The compactness and the high safety level when handling the shisha according to the invention is also achieved in that heating the smoke medium is not done by burning coal, as is the case with previously known shishas. Instead, electronics are used, through which the heat development can be controlled naturally much more effectively, safely and selectively. The suggestion according to which an electronic control unit is positioned between the container or the heating chamber and the accumulator is to be understood in this sense.

It is also conceivable that an electronic measuring, control and/or regulating unit is positioned between the container or the heating chamber and the accumulator that serves to monitor, control and/or regulate the heating function in the heating chamber and the temperature in the heating chamber. Therefore, if appropriate sensors are employed, the control unit can also influence the heating function in the bottom chamber, i.e. in the first place started and closed down and regulated. This is also associated with a completely new enjoyment factor when smoking with the shisha, because input values such as the temperature in the chamber, and thus in the end the quality of the tobacco product, can be varied by the user and/or automatically through the control unit when given limit values are reached. Alternatively, or in supplement, it is conceivable that the control unit is used to switch the shisha on and off and for standby switching. This means that automatism is possible through the air flow. For example, a sensor can be used for monitoring, which then forwards the appropriate signals to the control unit.

A further embodiment of the invention provides that the water pipe is equipped with a communication interface, so that the control unit serves communication with the user and/or external appliances, for example via NFC or Bluetooth technology. Influence on the controller can then be exercised through an interface of this type via an external control unit, for example a smartphone or a Tablet PC. This means it is possible to draw up a user profile or to communicate the smoking experience, for example via Facebook or other social media. Reordering tobacco capsules in this way is also conceivable.

The connection between the water tank and the heating chamber is necessary in order to draw the smoke medium through suction initially into the heating chamber and then into or through the tank. The most expedient is an embodiment in which the heating chamber and the container are connected by means of at least one suction tube. For this purpose it is necessary that the suction tube passes through the accumulator and/or the electronic control unit or that the suction tube is led past the accumulator and/or control unit.

It is understood that in the housing according to the invention the mixture is intended to stream or flow in one direction only, i.e. through the air inlet into the lower heating chamber and from there through the intake tube into the tank, in order to be inhaled there finally by the smoker. For this reason, it is recommended that a unidirectional valve is provided between the suction tube and the container that prevents the penetration of liquid medium from the container into the suction tube.

An essential aspect of the invention is that air is drawn from outside into the heating chamber and the air then actually comes into contact with the smoke medium provided in the capsules as intensively as possible and with an optimum mixing together of air and smoke medium. For this purpose, a capsule must have one or more holes at least at one end or even be perforated. The opening of the smaller upper hole is produced expediently in that the suction tube serves at the same time as a mandrel, that is, when the capsule is inserted into the lower chamber the suction tube penetrates into the capsule and in this way enables the smoke medium to enter the suction tube and thus in the end the water tank and can be released there.

To simplify disposing of the waste water from the container and filling it with fresh water it is planned that the container and the housing are connected detachably, for example by means of a plug-in, a latched or a magnetic connector. This creates a modular structure with the components capsule, heating chamber, power/electronics, water tank, lid, tube and mouthpiece.

The invention is characterised in particular in that a water pipe or shisha is created that is noticeable through special compactness, safety, user-friendliness, easy cleaning and numerous possible variations. The user sucks air through an inlet on the underside of the housing first of all into a heating chamber, in which the tobacco or non-tobacco smoke medium is located, expediently in a capsule that is to be inserted into the heating chamber like an oven. The capsule therefore lies in the air flow, which the user generates at the upper end of the housing by breathing in, i.e. by creating negative pressure. At the same time, the smoke medium is heated up in the capsule by means of a heating mechanism supplied through an accumulator. From the heating chamber, or more exactly from the capsule inserted there, the mixture of air and smoke medium passes through a suction tube into the upper container, also to be referred to as water tank, where it passes through the water and can then be inhaled via a suction device. The capsule for holding the medium is here an integral component of the heat and air stream with no loss of aroma with regard to the smoke medium. Thanks to its electronic controller, the shisha according to the invention opens up completely new possibilities, because the heating processes can be monitored, controlled and/or regulated. In any case, the air flow is defined through the prefabricated openings/holes on the top and underside, heating takes place preferably on the side surface in the heating chamber. The use of capsules creates further possibilities in the form of variants for the smoke medium, its composition and intensity.

BRIEF DESCRIPTION OF THE DRAWINGS

Further details and advantages of the subject of the invention can be seen in the following description of the associated drawing, in which an example of a preferred embodiment is shown with the necessary details and individual parts. Respectively.

DETAILED DESCRIPTION

Figure 1:
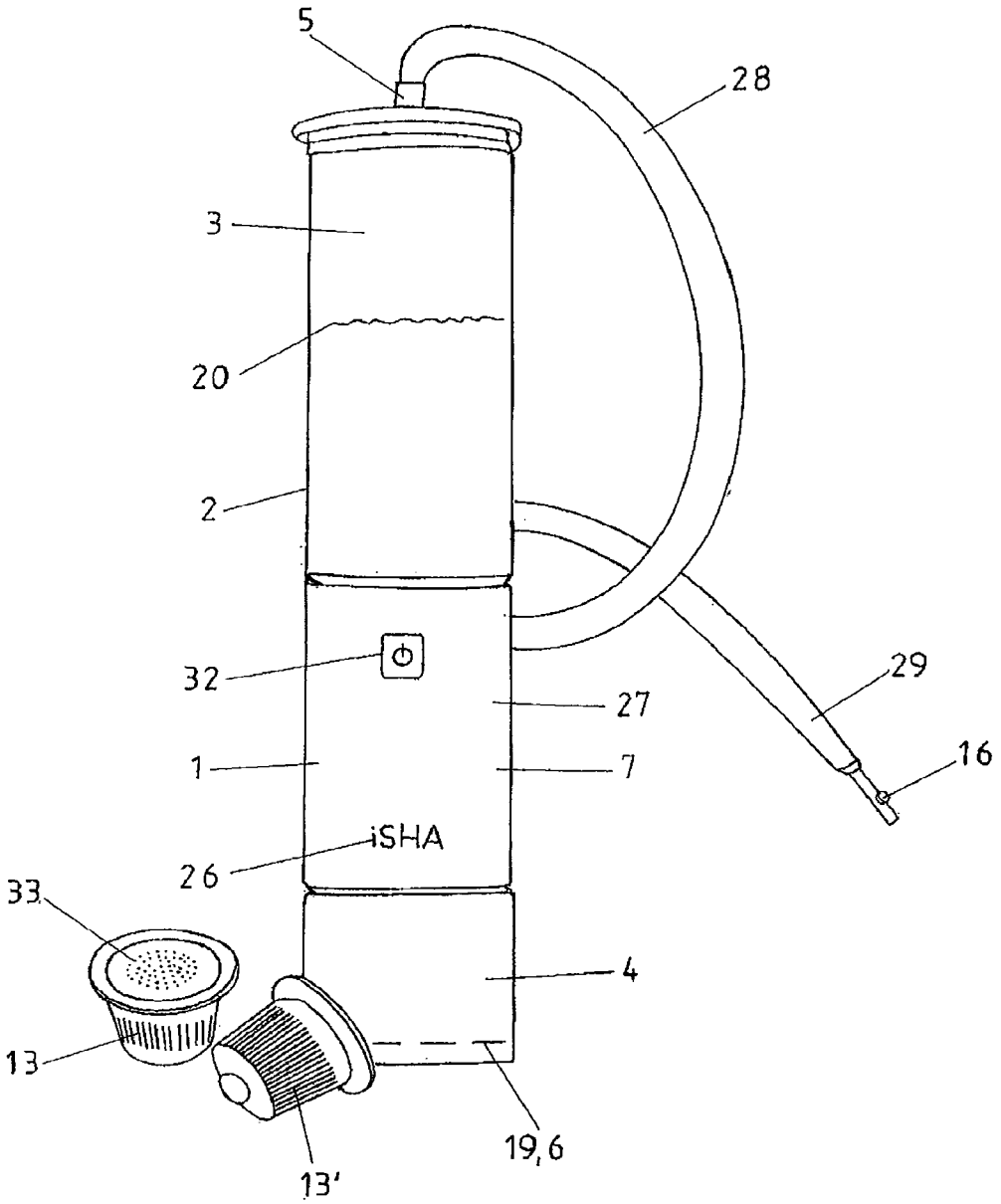
FIG. 1 Shows a side view of a water pipe.

FIG. 1 already makes the particular compactness of the water pipe 1 clear with its lengthways housing 2 and the modular structure. The container 3 is closed above through the cover 15. A suction tube 28 is connected with its integral end with the connecting pieces 5 as part of the cover 15 and is fitted at the other end with an interchangeable mouthpiece 16. The connection of several tubes 28, 29 is conceivable. By means of a magnetic connector the mouthpiece 16 of the tube 28 can be fixed detachably to the outer wall of the housing or the cover 15. The water level for the water in reserve in the container 3 is designated 20, because only partial filling of the container 3 is expedient. Heating chamber and accumulator and control unit are concealed by a casing 27, which along with many other details characterises the design of a water pipe 1 of this type, among other things through the possible impression or engraving 26 for advertising purposes. The on and off and standby switch for controlling the shisha is designated 32. Two capsules with perforations 33 holding smoke medium are indicated with 13, 13'. The air inlet in the form of several air slots 19 has the reference number 6.

Figure 2:
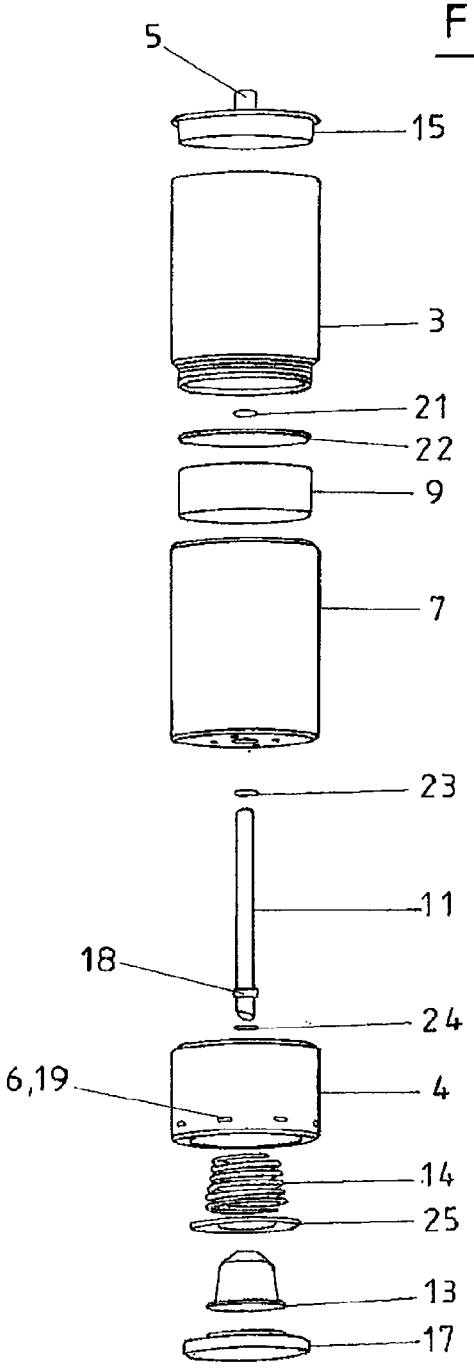
FIG. 2 Shows a water pipe in an exploded view.

In an exploded drawing, FIG. 2 then shows a shisha 1 according to the invention. With the air inlet in the form of slits 19 indicated with the reference number 6 the user sucks air from outside into the heating chamber 4, where smoke medium is kept in an exchangeable capsule 13. A heating spiral 14 whose conical shape is adapted to that of the capsule 13—or vice versa—is provided as heating medium in the lower chamber 4. An adapter disc that guarantees the correct fixing of the capsule 13 is marked 25. The lower chamber 4 in the form of a small oven is connected through the suction tube 11 with the container 3, which itself is covered on the top by the cover 15 and has a connection 5 for a tube 28, 29 with mouthpiece 16 at the other end. The walls of the container 3 that serves as a tank consist preferably of acrylic glass. The cover 15, panelling 27 and heating chamber 4 or its walls consist preferably of brushed or sandblasted stainless steel, aluminium or ceramics. The intake tube 11 guarantees that the mixture of air and smoke medium can pass from the lower chamber 4 into the container 3. An additional seal or separator is provided by means of a unidirectional valve 12, an O-ring 21 and a cover plate 22. The suction tube 11 is sealed by means of Teflon discs 24, 23 on the one hand as against the lower chamber 4 and on the other as against the accumulator 8 or its chamber 7. A measuring, regulating and/or control unit is shown with 9 that, for example in interplay with a sensor, serves for monitoring, controlling and regulating the heating chamber 4. The capsule 13 for holding the medium here an integral component of the heat and air flow, by which means the aroma of the smoke medium is retained in full.

Figure 3:
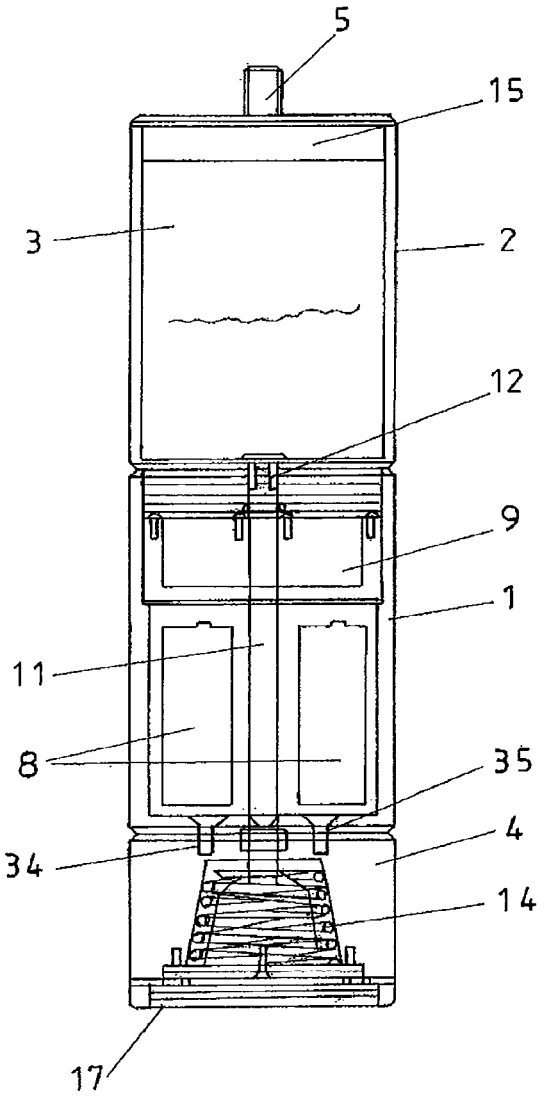
FIG. 3 in the longitudinal section.

In the longitudinal section FIG. 3 shows a shisha 1 according to the invention, whose container 3 is filled with water up to the water level 20. The unidirectional valve 12 that is integrated in the bottom of the container 3 can be seen clearly here as well. In addition, the longitudinal section shows the electrics shaft with the measuring, regulating and/or control unit 9 and the suction tube 11, with is led in the middle through the accumulators 8 and finally ends in the heating chamber 4. If a capsule is now inserted into the heating chamber 4, the suction tube 11 penetrates into the capsule 13 with its lower end 18 and releases the mixture. The capsule 13 is fixed in the heating chamber 4 through the base plate 17, the air supply is guaranteed through the air slits 30 found in the heating chamber 4.

Figure 4:
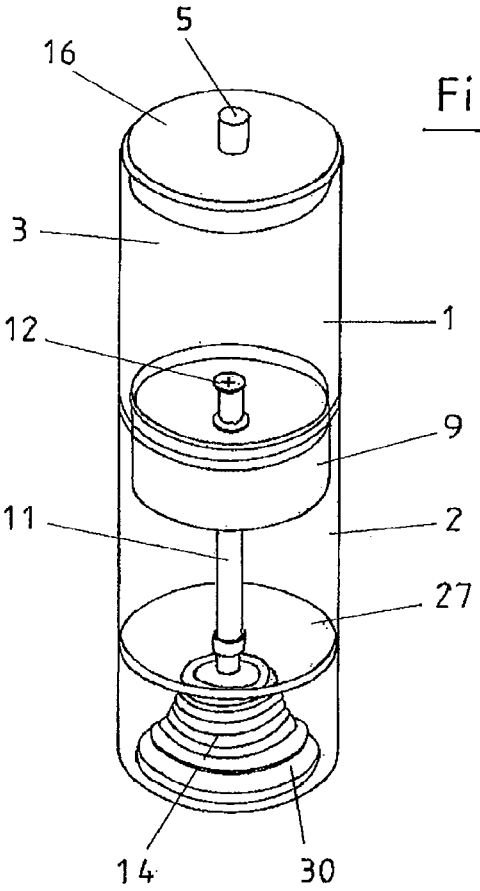
FIG. 4 in a view at an angle from above.

FIG. 4 shows a simplified representation of the housing 3 with the upper container 3 for the water and the unidirectional valve 12 in the direction of the suction tube 11.

Figure 5:
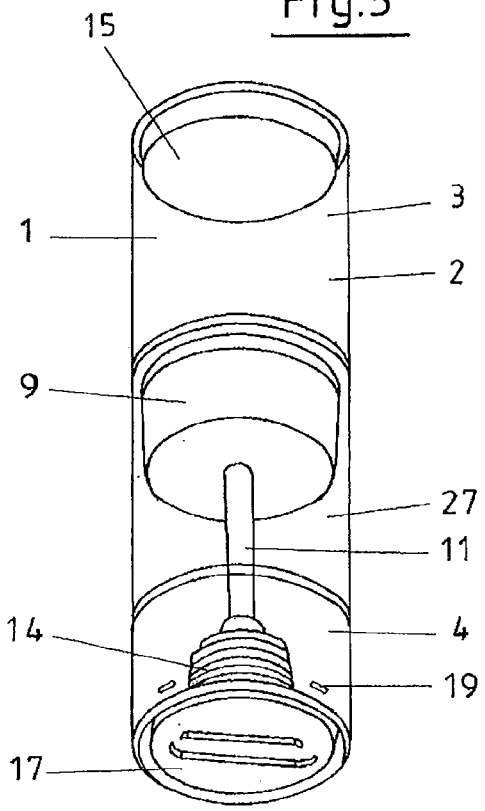
FIG. 5 in a view at an angle from below.

In the drawing in FIG. 5 the focus is on the view of the housing 2 from below with the air slit 19 in the heating chamber 4 for sucking in ambient air into the inside of the housing 2.

Figure 6:
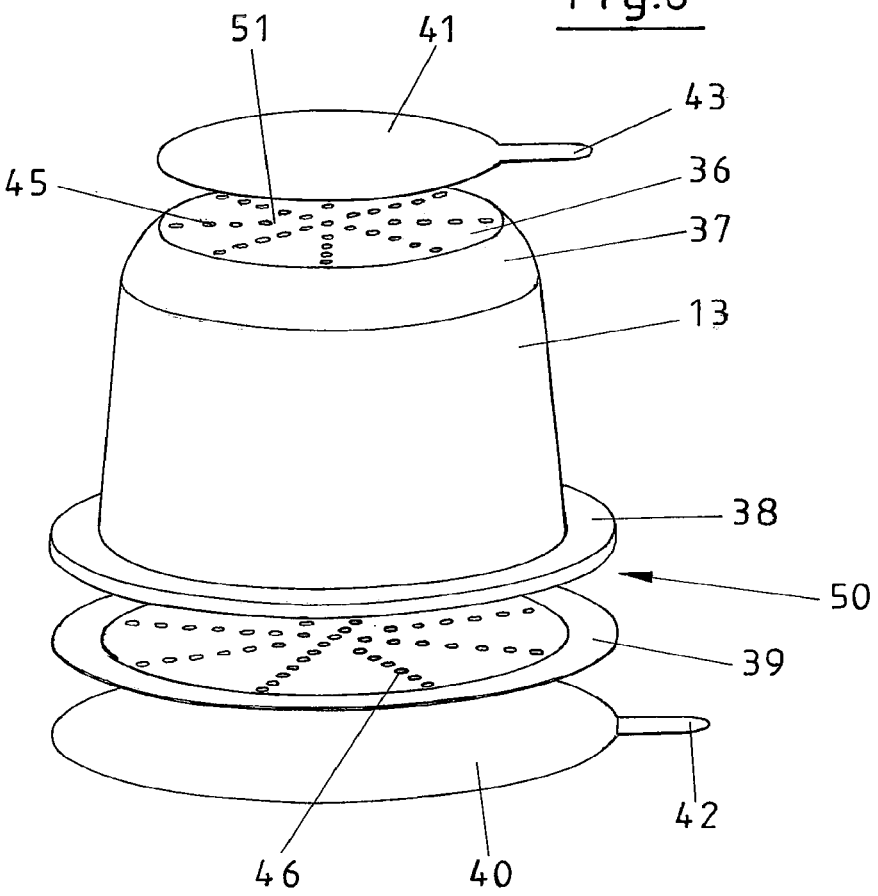
FIG. 6 Shows an exploded view of a capsule.

FIG. 6 shows a exploded representation of a capsule 13 with two end plates 36, 39 at the inlet 50 and outlet 51 respectively. The capsule 13 has a taper 37 that passes into the front end plate 36. An aroma protection foil 41 with a handle 43 serves to seal the holes 45 in the end plate 36 and must be removed directly before use. In supplement, the capsule 13 comprises an additional aroma protection foil 40 with handle 42 that corresponds to the rear end plate 39 and therefore to the holes 46 etc. The collar 38 serves to fasten the aroma protection foil 40 and capsule 13 in place.

Figure 7:
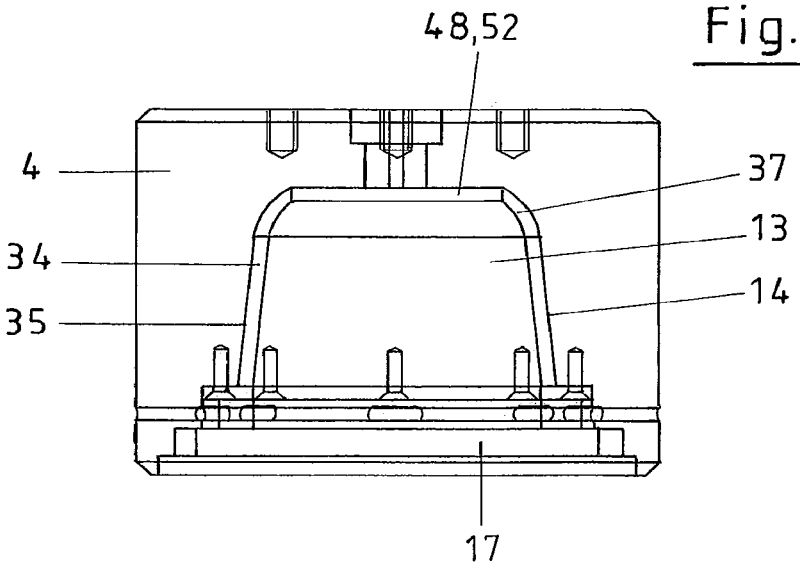
FIG. 7 shows the capsule in the heating chamber.

As an alternative to FIG. 3, FIG. 7 shows a capsule 13 in the heating chamber 4 of the smoking appliance that is otherwise not shown here. The heatable receptacle 34 approx. 2 mm thick for the capsule 13 with its wall 35 has a taper 37; capsule 13 and receptacle 34 are formed to correspond with each other, capsule 13 sits firmly in the receptacle 34. Because the receptacle 34 ends on connection to the taper 37 or has an opening 52, an advantageous free space 48 remains for the extraction process.

Figure 8:
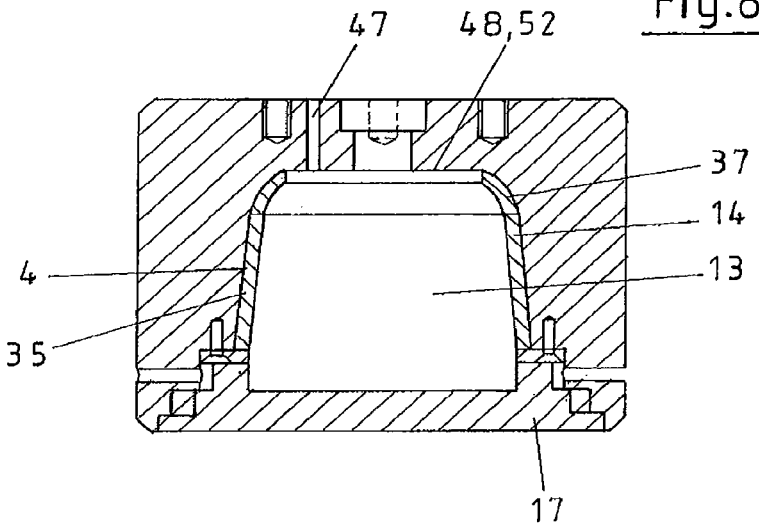
FIG. 8 shows a cross-section of FIG. 9.

This is also made clear in the section in accordance with FIG. 8 that shows the opening 52 in the area of the receptacle 34. The base plate for sealing the heating chamber 4 has the number 17. A drill hole 47 serves to lead power to the receptacle 34, which also serves as a heating element.

Figure 9:
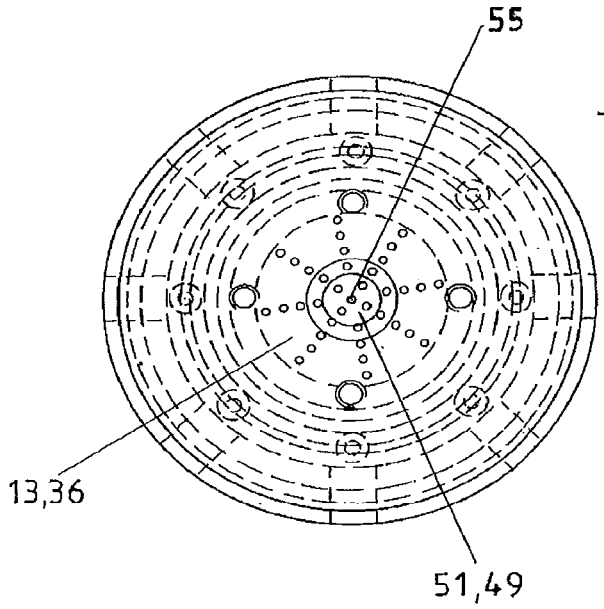
FIG. 9 shows a top view of the capsule in the heating chamber.

Finally, FIG. 9 illustrates the view from above onto the receptacle 34 and the capsule 13 with its front end plate 36. This also illustrates the centre 49 of connection plate 36, which has a particularly high number of holes, one of which is numbered 55 by way of an example, in order to guarantee the intended optimal extraction without the risk that smoke medium could penetrate into the suction tube.

What is claimed is:

1. An electronically heated water pipe comprising:

a housing comprising:

a container configured to hold a liquid medium and having at least one suction connection; and a heating chamber having an air inlet and including a receptacle for a smoke medium, the receptacle connected to the container via a suction tube extending from the receptacle to the container, the suction tube sealed against the receptacle; and an electronic unit for controlling heating of the receptacle in use, the electronic unit being positioned between the container and the heating chamber, the electronic unit comprising an accumulator;

wherein the accumulator is configured to supply power to the heating chamber, and the accumulator is integrated in the housing above the heating chamber;

wherein the receptacle has a capsule opening configured to receive a capsule adapted to hold a smoke medium;

wherein the receptacle has a side wall that includes a taper and is configured to surround a side of the capsule while the capsule is disposed within the receptacle; and wherein the side wall further comprises a heating element configured to heat the capsule, the heating element being adapted to a shape of the capsule and surrounding the side of the capsule.

2. The water pipe in accordance with claim 1, wherein:

the receptacle can be sealed with a base plate to define a cavity in which the capsule is configured to be contained within; and wherein the air inlet is defined by the heating chamber.

3. The water pipe in accordance with claim 1, wherein a bottom end of the receptacle defines the capsule opening such that the capsule can be inserted into the heating chamber from below when a base plate is removed.

4. The water pipe in accordance with claim 1, wherein:

a base plate is configured to cooperate with the receptacle to define a cavity corresponding to a volume of the capsule; and the capsule is configured to be secured within the cavity when the base plate is fixed, screwed or inserted into the receptacle.

5. The water pipe in accordance with claim 1, wherein the accumulator is configured such that the suction tube passes through the accumulator.

6. The water pipe in accordance with claim 1, wherein the water pipe is fitted with a communication interface.

7. The water pipe in accordance with claim 1, wherein a unidirectional valve configured to prevent penetration of liquid medium from the container into the suction tube is provided between the suction tube and the container.

8. The water pipe in accordance with claim 1, wherein the suction tube penetrates into the capsule such that the capsule is in communication with the container.

9. The water pipe in accordance with claim 1, wherein the container and the housing are connected detachably to each other.

10. The water pipe in accordance with claim 1, wherein the heating element is spiral in form, is conical in form, or a combination thereof.

11. The water pipe of claim 1, wherein the heating element is has a conical form and is figured to adapt to the taper of the side wall of the receptacle.

12. The water pipe of claim 1, further comprising a standby switch for the electronic unit.

13. A water pipe for producing smoke from a smoke medium contained in a removable capsule, the water pipe comprising:

a housing that includes:

a container configured to be filled with a liquid medium;

at least one suction connection coupled to the container;

a heating chamber coupled to the housing, the heating chamber comprising:

a receptacle defining an oven configured to receive the removable capsule, the oven having a capsule opening and a side wall laterally surrounding the capsule such that an outer side surface of the removable capsule contacts the side wall of the oven; and the side wall of the oven comprising a heating element surrounding the capsule and configured to heat the oven in use; and the receptacle is connected to the container via at least one suction tube extending from a first end of the receptacle to the container; and wherein, while the removable capsule is disposed within the oven, the receptacle is configured to provide heat input laterally to the removable capsule from the heating element to heat the smoke medium disposed within the removable capsule and produce smoke that is delivered to the container; and a second end of the receptacle defines the capsule opening configured to receive the removable capsule within the heating chamber, wherein the receptacle is situated below the container and the second end of the receptacle is disposed below the first end of the receptacle such that the removable capsule can be inserted into the oven from below.

14. The water pipe of claim 13, further comprising a base plate that is removably coupled to the second end of the receptacle to enclose the heating chamber.

15. The water pipe of claim 13, wherein the first end of the receptacle defines a second opening in fluid communication with the container via the at least one suction tube.

16. The water pipe of claim 13, wherein:

the heating element is conical; and the heating element is positioned relative to the receptacle such that the heating element surrounds an outer side surface of the removable capsule while the removable capsule is disposed within the heating chamber.

17. The water pipe of claim 13, further comprising the removable capsule, the removable capsule defining a cavity configured to contain the smoke medium.

18. The water pipe of claim 17, wherein the removable capsule includes:

a capsule body tapered from a second end toward a first end of the capsule body;

a front end plate forming part of the first end of the capsule body, the front end plate defining a first plurality of apertures; and a back end plate coupled to the second end of the capsule body, the back end plate defining a second plurality of apertures.

19. The water pipe of claim 13, wherein the outer side surface of the removable capsule contacts the side wall of the oven, such that the second end of the receptacle is spaced from a first end of the removable capsule by a free space.

20. The water pipe of claim 13, the oven having an adapter ring at the capsule opening and configured to receive the removable capsule, wherein the adapter ring is distinct from the receptacle and is mounted onto the receptacle.

* * * * *